US005613629A

United States Patent [19]

Zuckerman

[11] Patent Number: 5,613,629

[45] **Date of Patent: *Mar. 25, 1997**

[54] HANGER WITH INFORMATION TAB

[75] Inventor: Andrew M. Zuckerman, Forest Hills, N.Y.

[73] Assignee: Different Dimensions Inc., Rego Park, N.Y.

[ * ] Notice: The term of this patent shall not extend beyond the expiration date of Pat. No. 5,199,608.

[21] Appl. No.: 589,594

[22] Filed: Jan. 22, 1996

Related U.S. Application Data

[62] Division of Ser. No. 377,189, Jan. 24, 1995, Pat. No. 5,485,943, which is a division of Ser. No. 42,811, Apr. 5, 1993, Pat. No. 5,383,583, which is a division of Ser. No. 801,613, Nov. 22, 1991, Pat. No. 5,199,608, which is a continuation of Ser. No. 591,621, Oct. 2, 1990, abandoned.

[51] Int. Cl.[6] ..... A47G 25/14

[52] U.S. Cl. ..... 223/85; 40/322

[58] Field of Search ..... 223/85, 88, 92, 223/95; 40/322

[56] References Cited

U.S. PATENT DOCUMENTS

| | | | |
|---|---|---|---|
| 3,949,914 | 4/1976 | Ostroll | 223/85 |
| 4,115,940 | 9/1978 | Phillips | 40/322 |
| 4,997,114 | 7/1989 | Petrou | 223/85 |
| 5,199,608 | 4/1993 | Zuckerman | 223/85 |
| 5,383,583 | 1/1995 | Zuckerman | 223/85 |
| 5,485,943 | 1/1996 | Zuckerman | 223/85 |

*Primary Examiner*—Bibhu Mohanty
*Attorney, Agent, or Firm*—Amster, Rothstein & Ebenstein

[57] ABSTRACT

A garment hanger having an indicia-bearing tab for displaying customer information is provided. A tab holder is integrally formed as part of the hanger. The tab is mounted on an edge of the tab holder, adjacent a ridge formed on the tab holder. The ridge, together with two end members formed on the tab holder on either side of the tab, prevent a consumer from obtaining a finger purchase on the tab. Thus, once the tab is mounted on the tab holder, it cannot be removed without using a tool. The dimensions of the ridge and end members, and their location on the tab holder, may be selected to prevent removal of the tab by hand or by tool.

9 Claims, 2 Drawing Sheets

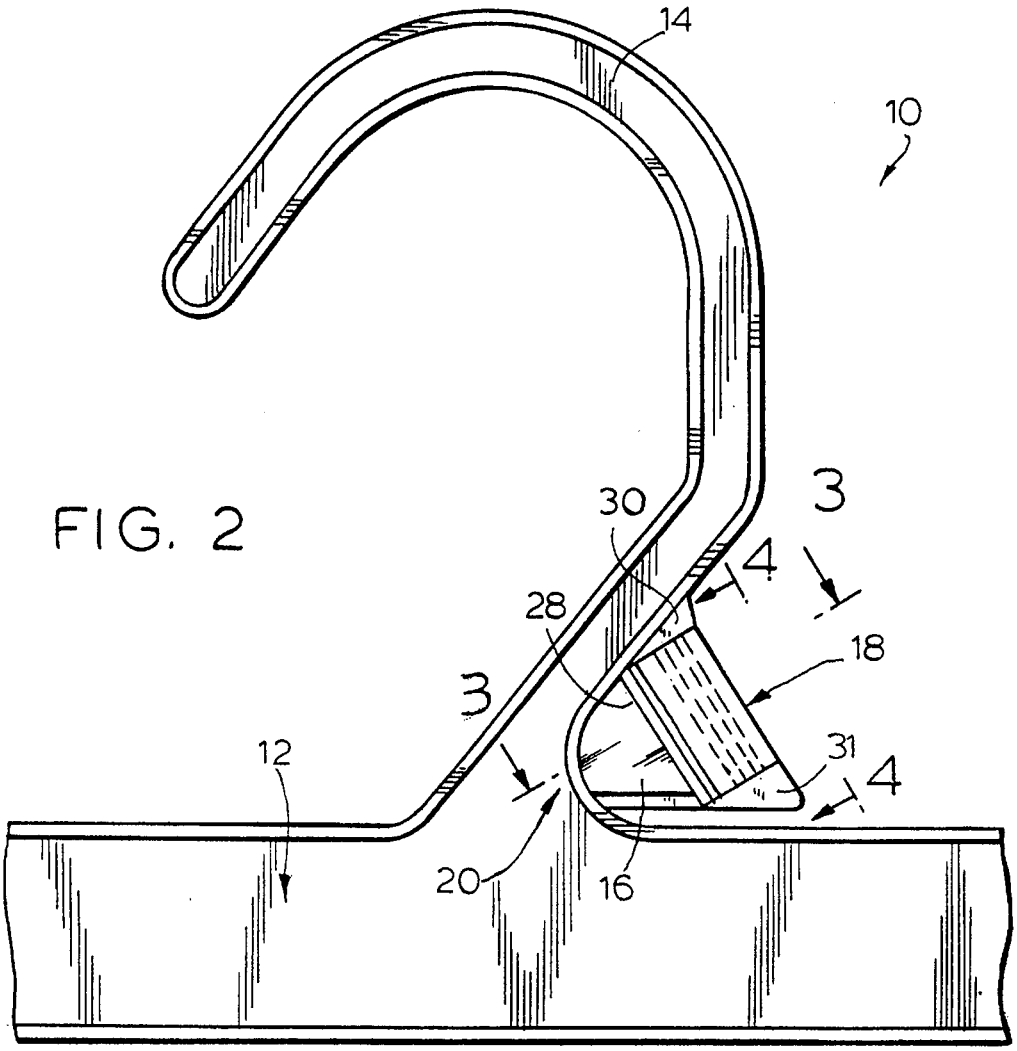
FIG. 2
FIG. 3
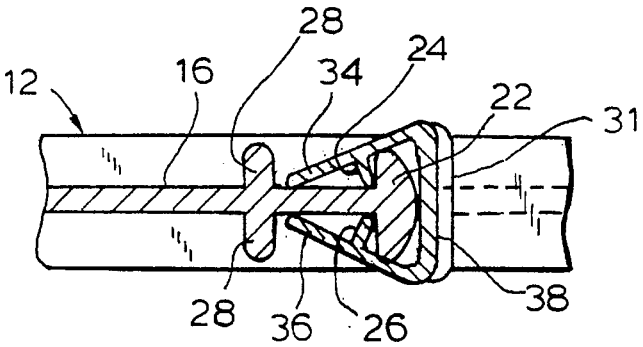

HANGER WITH INFORMATION TAB

This is a divisional of application Ser. No. 08/377,180 now U.S. Pat. No. 5,405,943 filed Jan. 24, 1995 which is a divisional of Ser. No. 08/042,811 now U.S. Pat. No. 5,383,583 filed Apr. 5, 1993, which is a divisional of Ser. No. 07/801,613 now U.S. Pat. No. 5,199,608 filed on Nov. 22, 1991, which is a continuation of Ser. No. 07/591,621 filed Oct. 2, 1990 now abandoned.

BACKGROUND OF THE INVENTION

This invention relates to a hanger having an information tab. More particularly, this invention relates to a garment hanger having a tab holder for receiving an information tab which, once attached to the tab holder, cannot be removed by hand.

It is desirable to provide garment hangers which can display information to prospective customers. For example, a garment hanger may display information regarding the size or brand of clothing on the hanger. It is also desirable to provide other types of hangers, such as display hangers for displaying swatches of fabric or carpet, which can display information to prospective customers.

One prior method for providing customer information on a garment hanger involved placing disks or tabs with printed information over the hook of the hanger. Information tabs of this type are easily dislodged or removed.

Another method for providing customer information on a hanger involved printing information on a tab which connected to the hanger by means of spring clips that are provided with a finger purchase. Such information tabs also are easily removed. Hangers of this type typically may be sold with the garment it carries. Once in the purchaser's home, the removable information tab may pose a danger to children who may swallow it.

It would be desirable to provide a hanger which holds an information tab securely and permanently. It would also be desirable to provide a hanger with an information tab which is easily mounted by sales personnel or by an apparel manufacturer, yet suitable for distribution to purchasers of clothing.

SUMMARY OF THE INVENTION

In view of the foregoing, it is an object of this invention to provide a hanger which readily accepts and securely holds an information tab.

It is a further object of this invention to provide a hanger with an information tab which is easily mounted by sales personnel or by an apparel manufacturer, but is not readily removable from the hanger once mounted.

It is another object of this invention to provide an information tab which may be attached to a variety of hangers without regard to the physical characteristics of the body or hook portions of the hangers.

These and other objects of the invention are accomplished by providing a garment hanger having a tab holder which is integrally formed as part of the hanger. A tab, suitable for displaying information, attaches to the tab holder.

The tab holder extends from the hanger and has two free edges (i.e., edges which are not connected to the hanger body or hook). Alternatively, the tab holder connects the body and hook portions of the hanger at the base of the hook, and has a single free edge. The information tab includes a face member for displaying information and resilient or spring-loaded (e.g., caused by plastic memory) arms for gripping the tab holder.

The tab holder includes an integrally molded rib which extends parallel to one of the free edges of the tab holder. The rib is positioned and sized such that it prevents a person from obtaining a sufficient finger purchase on the information tab to remove the tab from the tab holder.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which:

FIG. 2 is a partial side elevational view of the hanger of FIG. 1 with the information tab mounted;

FIG. 3 is a cross-sectional view of the tab and tab holder of FIG. 2, taken along line 3—3.

DETAILED DESCRIPTION OF THE PREFERRED EMBODIMENTS

Figure 1:
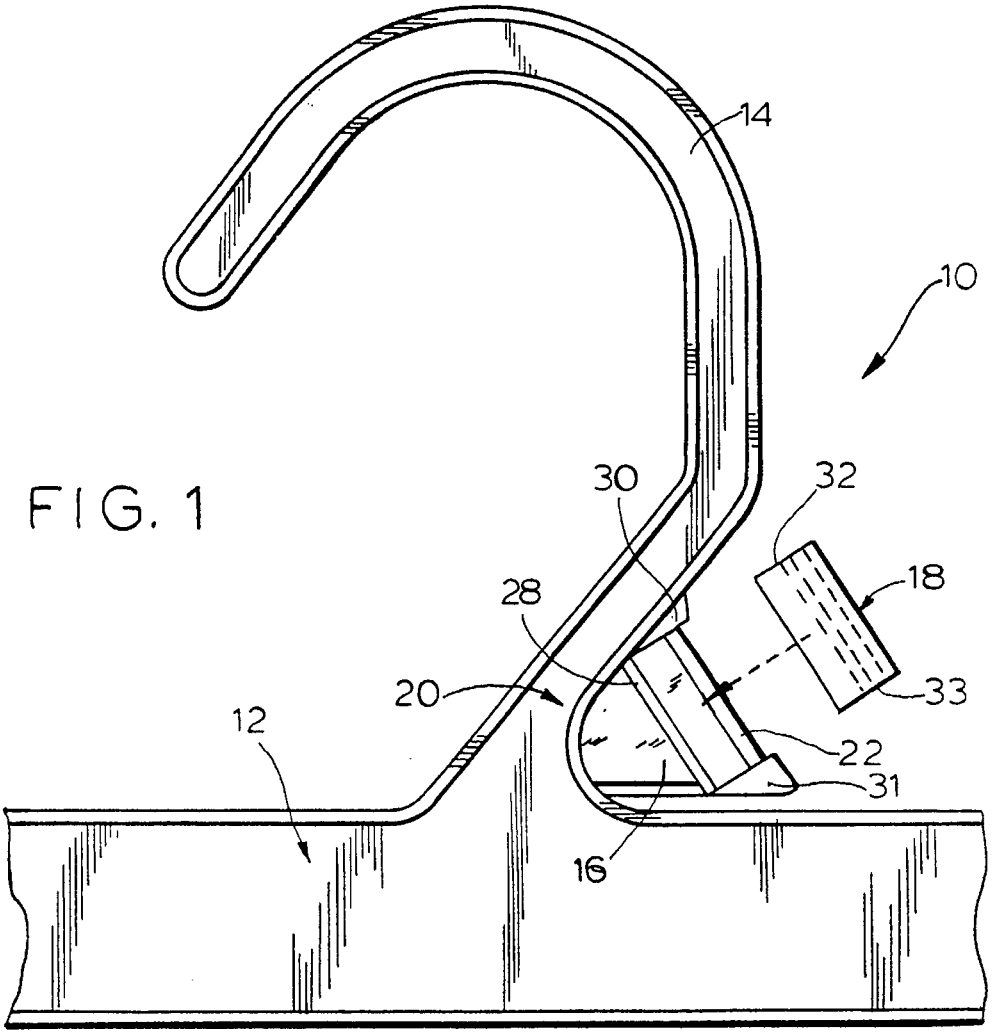
FIG. 1 is a partial side elevational view of a preferred embodiment of the garment hanger of the present invention, prior to mounting the information tab.

Referring now to the drawings, FIG. 1 illustrates a garment hanger, designated generally by reference numeral 10. As used herein, the term "garment hanger" is understood to refer to hangers for clothing, as well as hangers for non-clothing items. Hanger 10 includes a body 12, a hook member 14, and a tab holder 16. Hook member 14 may take any shape, such as the curved shape shown in FIG. 1, or for example, a straight nail. Tab holder 16 is adapted to receive and securely hold an information tab 18. Information tab 18 typically may be used to display information, such as a garment size or brand.

Garment hanger 10 can be planar or contoured. Hanger 10 and information tab 18 may be formed of any suitable material, such as polystyrene, polypropylene, ABS, or Nylon. Hook member 14 alternatively may be formed of metal. The hanger typically may be constructed using conventional injection molding techniques, though other techniques may be used.

Tab holder 16 preferably is integrally formed with body 12. Tab holder 16 preferably joins hook member 14 (or body 12) along a single edge 20, and extends from hook member 14 in the plane of the hanger. The tab holder preferably has at least two free edges, and is generally planar. By virtue of this design, tab holder 16 may be formed in any desired shape and size. However, the garment hanger of this invention may also be formed with just a single free edge. Tab holder 16 may attach to both body 12 and hook member 14. In either embodiment, a single tab model (of a predetermined size and shape) may be compatible with several models of garment hangers varying in design and size.

Tab holder 16 includes a ridge 22 for mounting tab 18. Ridge 22 is disposed at and along a free edge of the tab holder (on both sides of the tab holder). Projecting members 24 and 26 (shown in FIG. 3) of tab 18 cooperatively engage ridge 22. Tab holder 16 includes a second ridge 28, which is parallel to and spaced apart from ridge 22. Ridges 22 and 28 extend outward from the plane of the tab holder, extending from both sides of the tab holder.

Tab holder 16 typically may include end members 30 and 31. End members 30 and 31 define the position along ridge 22 at which the tab may be attached to the tab holder. Ridge 28 and end members 30 and 31 prevent a consumer from obtaining a finger purchase on tab 18 sufficient to clear projecting members 24 and 26 from ridge 22, thereby rendering tab 18 irremovable once the tab is mounted. As used herein, an "irremovable" tab refers to a tab which cannot easily be removed by an adult, and cannot be removed by a child of an age likely to ingest tab 18, without the use of a tool. This feature is desirable, for example, when a hanger is given to a customer along with the garment it carries. The irremovable nature of the information tab minimizes the danger to small children in the customer's home. Hangers with irremovable tabs are also useful in preventing inadvertent dislodging and possible subsequent mislabeling of garments in a store. Once tab 18 is mounted by the store personnel, it cannot be accidentally dislodged by consumers. If the tab must be changed, the store personnel can remove the tab, without damaging tab holder 16, using a tool.

Although the tab has been described as being removable using tools, it is within the scope of this invention to construct a hanger with an information tab which cannot be removed, without breaking the tab, even using a tool. The location of ridge 28 and end members 30 and 31 on the tab holder can be selected to vary the level of difficulty associated with removing tab 18. For example, positioning end members 30 and 31 such that tab 18 fits snugly between them when the tab is mounted on tab holder 16 makes the tab difficult to remove, even when a tool is used. End members 30 and 31 typically may also prevent a consumer from obtaining a finger (or fingernail) purchase on the edge surfaces 32 and 33 of tab 18. The dimensions of ridge 28 and end members 30 and 31 relative to the plane of the tab holder also can be selected to increase or decrease the ease with which tab 18 can be removed.

Figure 4:
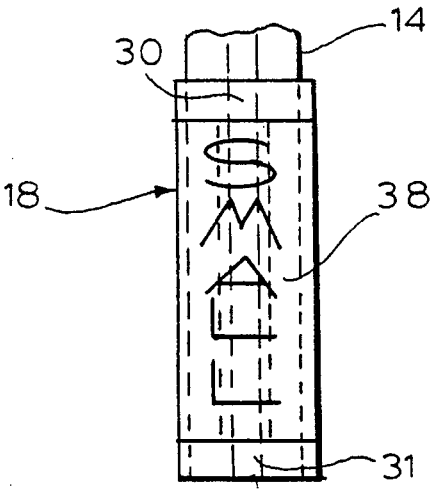
FIG. 4 is a side view of the tab of FIG. 2, taken along line 4—4.

Referring now to FIGS. 3 and 4, tab 18 includes spring-loaded sides 34 and 36 which extend synclinally from an information-bearing face member 38. Face member 38 may bear information in the form of a label, molded or raised lettering, or any other suitable form. Alternatively, face member 38 may be blank or suitable for marking by hand. Projecting members 24 and 26 (e.g., ribs) are disposed on the interior surface of sides 34 and 36. To mount tab 18, sides 34 and 36 are spread apart, enabling projecting members 24 and 26 to pass beyond edge 22 of tab holder 16. The tab is advanced toward ridge 28 until projecting members 24 and 26 are disposed beyond edge 22. The foremost edges of sides 34 and 36 (adjacent ridge 28) preferably are smooth or bevelled to prevent the consumer from obtaining a finger purchase on tab 18. Preferably, the foremost edges of sides 34 and 36 are sufficiently close to ridge 28 to prevent a consumer from inserting a fingernail between the foremost edge of sides 34 and 36, and ridge 28.

Thus a garment hanger having an irremovable tab for indicating customer information is provided. One skilled in the art will appreciate that the present invention can be practiced by other than the described embodiments, which are presented here for purposes of illustration and not of limitation, and the present invention is limited only by the claims that follow.

What is claimed is:

1. A garment hanger including a removal-resistant tab, comprising:

a hanger including a body and a hook member connected to said body;

a tab holder, formed integrally with said hanger, said tab holder having two opposite sides, a free edge, a longitudinal ridge extending from said two opposing sides and spaced from said free edge, an upper transverse ridge located above said longitudinal ridge and a lower transverse ridge located below said longitudinal ridge; and a tab which may be locked onto said tab holder, said tab including a face member and two opposing sides, each of said two opposing tab sides extending from said face member and terminating in a foremost edge opposite said face member, said face member and said two opposing sides of said tab forming an upper edge surface and a lower edge surface;

said longitudinal ridge of said tab holder being located relative to said foremost edges of said opposing tab sides such that, when said tab is locked onto said tab holder, said longitudinal ridge extends substantially the full length of and obstructs access to said foremost edges of said tab;

said upper and lower transverse ridges of said tab holder being located relative to said respective upper and lower edge surfaces of said tab such that, when said tab is locked on to said tab holder, said upper and lower transverse ridges extend substantially the full length of and obstruct access to said respective upper and lower edge surfaces of said tab.

2. The article of claim 1, wherein said tab holder further comprises a second free edge spaced from and parallel to said free edge.

3. The article of claim 1, wherein said tab holder is located between said hook member and said body.

4. The article of claim 1, wherein said foremost edges are bevelled.

5. The article of claim 1, wherein each said ridge is a continuous obstruction.

6. The article of claim 1, wherein said longitudinal ridge extends continuously between said upper and lower transverse ridges.

7. The article of claim 1 wherein said opposing tab sides extend from said face member sufficiently such that said foremost edges of said opposing tab sides are proximate to the near side of said longitudinal ridge when said tab is locked onto said tab holder.

8. A garment hanger including a removal-resistant tab, comprising:

a hanger including a body and a hook member connected to said body;

a tab holder, formed integrally with said hanger, said tab holder having two opposite sides, a free edge, a longitudinal obstruction extending from said two opposing sides and spaced from said free edge, an upper transverse obstruction located above said longitudinal obstruction and a lower transverse obstruction located below said longitudinal obstruction; and a tab which may be locked onto said tab holder, said tab including a face member and two opposing sides, each of said two opposing tab sides extending from said face member and terminating in a foremost edge opposite said face member, said face member and said two opposing sides of said tab forming an upper edge surface and a lower edge surface;

said longitudinal obstruction of said tab holder being located relative to said foremost edges of said opposing tab sides such that, when said tab is locked onto said tab holder, said longitudinal obstruction extends substantially the full length of and obstructs access to said foremost edges of said tab;

said upper and lower transverse obstructions of said tab holder being located relative to said respective upper and lower edge surfaces of said tab such that, when said tab is locked on to said tab holder, said upper and lower transverse obstructions extend substantially the full length of and obstruct access to said respective upper and lower edge surfaces of said tab.

9. The article of claim 1, wherein said upper and lower transverse ridges of said tab holder are substantially non-vertical, and, when said tab is locked onto said tab holder, said upper and lower edge surfaces of said tab are substantially non-vertical.

* * * * *